United States Patent [19]

Page, III

[11] 4,383,623

[45] May 17, 1983

[54] DISPENSING CLOSURE WITH STATIONARY AXIAL PLUG

[75] Inventor: Frank C. Page, III, Waterbury, Conn.

[73] Assignee: Ethyl Products Company, Richmond, Va.

[21] Appl. No.: 244,672

[22] Filed: Mar. 17, 1981

[51] Int. Cl.[3] ..... B67D 3/00; B65D 47/28; B65D 47/30

[52] U.S. Cl. ..... 222/521; 222/525

[58] Field of Search ..... 222/521, 525

[56] References Cited

U.S. PATENT DOCUMENTS

| | | | |
|---|---|---|---|
| 3,175,741 | 3/1965 | Porter | 222/521 |
| 3,240,404 | 3/1966 | Porter et al. | 222/521 |
| 3,578,223 | 5/1971 | Armour | 222/521 |
| 4,020,981 | 5/1977 | Nixdorff | 222/525 |

FOREIGN PATENT DOCUMENTS

| | | | |
|---|---|---|---|
| 1399492 | 7/1975 | United Kingdom | 222/521 |

*Primary Examiner*—David A. Scherbel

*Attorney, Agent, or Firm*—Donald L. Johnson; John F. Sieberth

[57] ABSTRACT

A two-piece, twist-on, twist off closure which permits fluids to be dispensed from a container. The two-piece closure includes an insert which can be fastened to a container, a post located in the center of the insert, and a sleeve which fits onto the outside of the insert and has a hole in the center thereof for receipt of the post to form a seal therewith.

2 Claims, 9 Drawing Figures

DISPENSING CLOSURE WITH STATIONARY AXIAL PLUG

BACKGROUND OF THE INVENTION

The present invention is related to dispensing closures. More particularly, the present invention is related to a two-piece dispensing closure in which the top must be turned in one direction to open and dispense the liquids, and in another direction to close the dispenser to seal liquids therein.

The present invention is utilized on a bottle or container for liquid material which is dispensed in small quantities such as liquid detergents, cleaning fluids, shampoo, and so forth. These materials are often sold in bottles which may be glass or plastic squeeze bottles, and in use a small quantity of the contained liquid is supplied by inverting the bottle or by squeezing the bottle when the bottle is plastic.

Various closures are known which can be affixed to a threaded bottle to allow dispensing of fluids therefrom. For examples of such closures, see U.S. Pat. Nos. 3,511,420; 3,599,845; and 3,981,421.

THE INVENTION

In accordance with the present invention there is provided a two-piece, twist-on, twist-off closure which permits fluids to be dispensed from a container. The two-piece closure includes an insert which can be fastened to a container, a post located in the center of the insert, and a sleeve which fits onto the outside of the insert and has a hole in the center thereof for receipt of the post to form a seal therewith.

An advantage of the present invention is that the sleeve can be made of plastic and forms a flush fitting plastic closure on a container. An aluminum or other metal sleeve may be fitted over the outside of the closure to improve the esthetic appearance of the closure. Furthermore, the closure of the present invention allows the product to be dispensed without removing the closure. In addition, there is a self-cleaning orifice in the closure and no bottle modification is required to use the closure.

DESCRIPTION OF THE PREFERRED EMBODIMENTS

Figure 1:
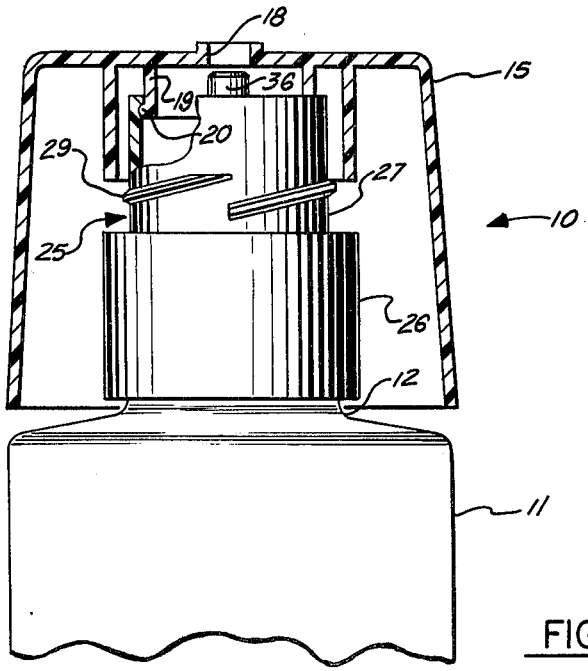
FIG. 1 is a partly sectional, partly cut-away, elevational view of a container having the closure of the invention thereon, with the closure in the dispensing mode.

In FIG. 1 is shown the dispensing closure of the present invention generally indicated by the numeral 10. Closure 10 is shown attached to the neck 12 of container 11.

The closure of this invention consists primarily of two elements. The first or outer element is a sleeve generally indicated by the numeral 15. Sleeve 15 can be seen in FIGS. 1 and 2, and in detail in FIGS. 3–5.

The second element is an insert generally indicated by the numeral 25. The insert can be seen in FIGS. 1 and 2, and in detail in FIGS. 6–9.

Figure 2:
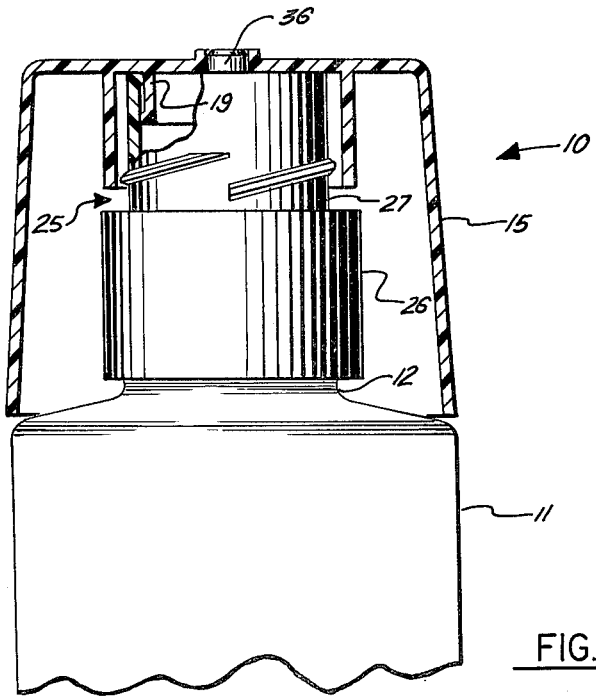
FIG. 2 is a partly sectional, partly cut-away, elevational view of a container having the closure of the invention thereon, with the closure in the sealed mode.

Insert 25 has a lower cylindrical portion 26 and an upper cylindrical portion 27. The lower cylindrical portion 26 has threads 28 on the inside thereof which permit the insert 25 to be screwed onto the neck 12 of the container 11 as shown in FIGS. 1 and 2. The neck 12 of the container must, of course, be threaded to mate with threads 28 in insert 25.

The upper portion 27 of insert 25 has threads 29 on the outside thereof which are adapted to engage threads 16 in the interior of sleeve 15. On the inside of the upper cylindrical portion 27 is an inner retaining ring 30 which extends inwardly from the upper end of the side wall of upper cylindrical portion 27.

Extending upwardly from the lower cylindrical portion 26 is an interior cylinder 34. Interior cylinder 34 has a series of openings 35 in the top thereof and a solid post 36 extending upwardly therefrom.

Figure 3:
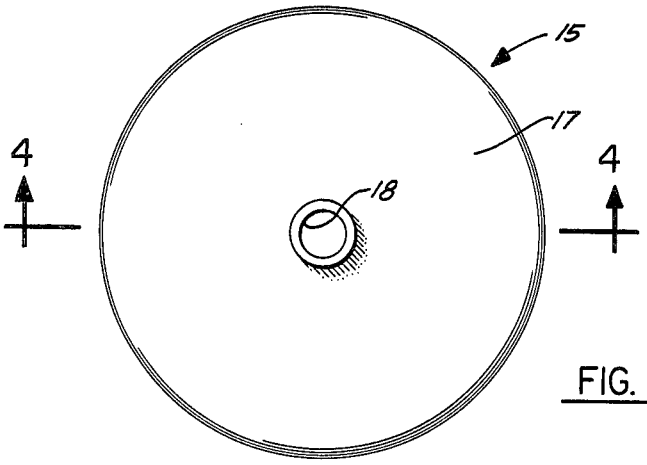
FIG. 3 is a top plan view of the sleeve of the invention.
Figure 4:
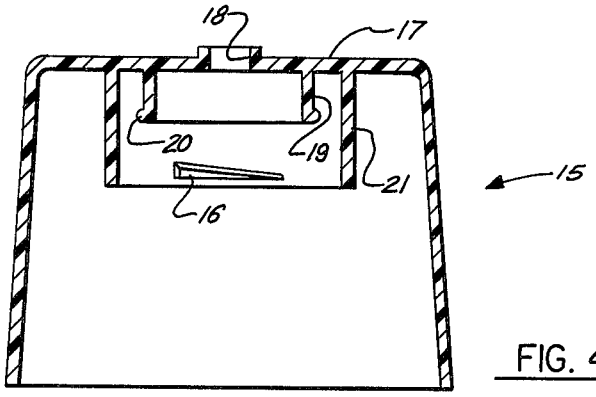
FIG. 4 is a cross-sectional view taken along lines 4—4 of FIG. 3.
Figure 5:
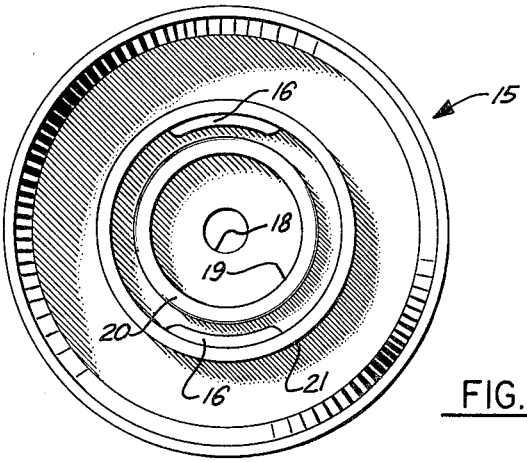
FIG. 5 is a bottom plan view of the sleeve of the invention.
Figure 6:
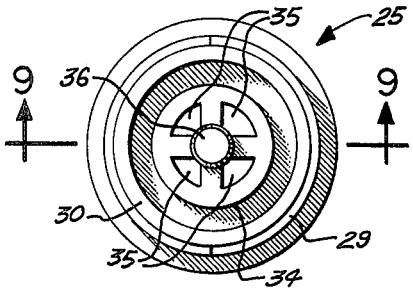
FIG. 6 is a top plan view of the insert of the invention.
Figure 8:
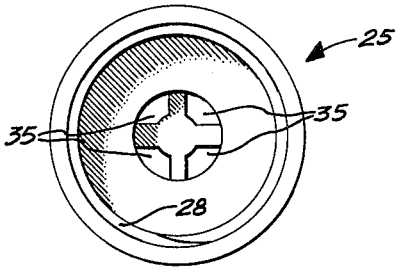
FIG. 8 is a bottom view of the insert of the invention.
Figure 7:
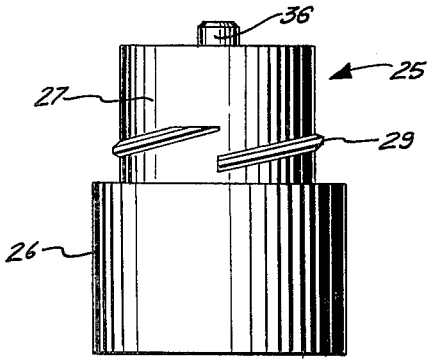
FIG. 7 is a side elevational view of the insert of the invention.
Figure 9:
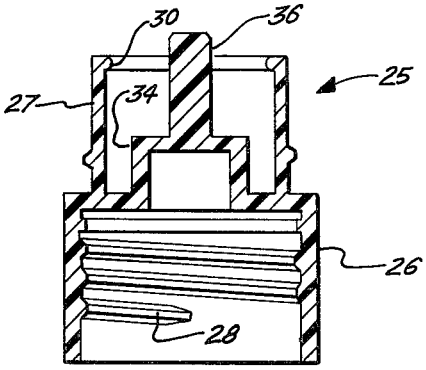
FIG. 9 is a cross-sectional view taken along lines 9—9 of FIG. 6.

Referring now to FIGS. 3–5, the sleeve of the invention is generally indicated by the numeral 15 in FIG. 3. Sleeve 15 is a cylindrical cap having a top 17 with an orifice 18 therein.

Extending downwardly from the top 17 of sleeve 15 is an inner cylinder 19. Inner cylinder 19 has a retaining ring 20 on the outside bottom end thereof which can be snap-fitted inside of retaining ring 30 in the interior of the upper cylindrical portion 27 of insert 25, as shown in FIGS. 1 and 2.

Also extending downwardly from the top 17 of sleeve 15 is an intermediate cylinder 21. Intermediate cylinder 21 completely encloses the inner cylinder 19. On the interior wall of intermediate cylinder 21 are a series of threads 16 which engage threads 29 on the outside of the upper cylindrical portion 27 of insert 25.

Referring now to FIGS. 1 and 2, the closure of the present invention is shown assembled on top of a container 11. Insert 25 is screwed onto neck 12 of the container which has threads (not shown) thereon. However, if desired, insert 25 can be attached to container 11 by any well-known means in the art such as by gluing, snapping, welding, or the like.

After insert 25 is firmly attached to container 11, sleeve 15 is fitted thereon by aligning the inner cylinder 19 of sleeve 15 with the upper cylindrical portion 27 of insert 25. After alignment is achieved, sleeve 15 is forced downwardly thereby causing ring 20 to slip into the interior of upper cylindrical portion 27. Upper cylindrical portion 27 must, of course, flex outwardly to allow inner cylinder 19 and ring 20 thereon to slip inside of ring 30 or upper cylindrical portion 27.

In the position shown in FIG. 1, the closure of the invention is in the dispensing mode. By inverting container 11 and/or squeezing the container if it is flexible, the contents thereof travels through openings 35, around post 36, and out through orifice 18. Retaining ring 30 is shown to be in contact with the retaining ring 20 and sleeve 15 is shown to be in the upper-most position.

To close the closure the sleeve 15 is forced downwardly and twisted clockwise to cause threads 16 in sleeve 15 to engage threads 29 on insert 25. Sleeve 15 is turned until the post 36 is forced upwardly into closure 18 to form a seal therewith while top 17 is forced downwardly onto the top of upper cylindrical portion 27 of insert 25.

The threads 16 are positioned relative to threads 29 such that after the threads are disengaged, the sleeve 15 rises off of the post 36 and spins freely. This eliminates the change of subjecting the insert 25 to any unwanted torque which might be encountered when turning the sleeve to a dispensing mode.

As is apparent from above, rings 30 and 20 act as "O" rings or sealing rings. Furthermore, they prevent the removal of the sleeve 15 from the insert 25 during normal use.

Although the preferred embodiments of the present invention have been disclosed and described in detail above, it should be understood that the invention is in no sense limited thereby and its scope is to be determined by that of the following claims:

What is claimed:

1. A two-piece dispensing closure for a container comprising:

a insert means connectable to the container, said insert means having an upper cylindrical portion with an inwardly extending retaining ring on its upper end, a post centrally mounted therein with fluid passages adjacent thereto, and having threads on the outside thereof;

b. sleeve means having a top portion with a central opening to sealingly receive said post, and connected to said insert means by a downwardly extending inner cylinder with an outwardly extending retaining ring at its lower end that is slidably received inside the upper cylindrical portion of said insert means, and by a downwardly extending outer cylinder having threads on the inside thereof for engaging the threads on outside of the upper cylindrical portion of said insert means;

c. the threads on the outside of the upper cylindrical portion of said insert means and the threads on the inside of the outer cylinder portion of said sleeve means being so positioned that both of said threads are entirely disengaged prior to the retaining ring on the downwardly extending inner cylinder of said sleeve means engaging the retaining ring on the upper cylindrical portion of said insert means.

2. A two-piece dispensing closure for a container comprising:

a. insert means which is connectable to a container, said insert means having an upper cylindrical portion with threads on the outside thereof, at least one hole therein for transmission of fluids therethrough, and a post in the center thereof, said upper cylindrical portion of said insert means having a retaining means around the inside wall thereof at the top thereof;

b. sleeve means for connecting to the outside of said insert means, said sleeve means having an orifice in the top thereof for sliding receipt of said post, said sleeve means having:

i. inner cylinder means extending downwardly from the top of said sleeve means, for sliding engagement with the inside of said upper cylindrical portion, said inner cylinder means having a retaining ring means on the outside thereof, whereby the two said retaining ring means prevent said inner cylinder means from sliding out of said upper cylindrical portion of said insert means and ii. intermediate cylindrical means having threads on its outside and extending downwardly from the top of said sleeve means and enclosing the said inner cylinder means; and c. said threads on the outside of said upper cylindrical portion of said insert means and said threads on the inside of said intermediate cylinder means of said sleeve means are positioned so that both of said threads are entirely disengaged prior to said retaining ring on the outside of said inner cylinder means of said sleeve means engaging or striking said retaining ring on the interior of said upper cylindrical portion of said insert means.

* * * * *